US007470846B2

(12) United States Patent
May

(10) Patent No.: US 7,470,846 B2
(45) Date of Patent: Dec. 30, 2008

(54) PERCUSSION INSTRUMENT REMOTE AIR MUTE

(76) Inventor: Randall L May, 2 Trafalgar, Newport Beach, CA (US) 92660

( * ) Notice: Subject to any disclaimer, the term of this patent is extended or adjusted under 35 U.S.C. 154(b) by 792 days.

(21) Appl. No.: 10/960,592

(22) Filed: Oct. 7, 2004

(65) Prior Publication Data

US 2006/0075876 A1 Apr. 13, 2006

(51) Int. Cl.
*G10D 13/08* (2006.01)

(52) U.S. Cl. ..... 84/411 R

(58) Field of Classification Search ..... 84/411 R, 84/327, 329, 453, 267, 274, 290, 411 M; 150/162; 206/312
See application file for complete search history.

(56) References Cited

U.S. PATENT DOCUMENTS

| | | | | |
|---|---|---|---|---|
| 573,320 | A | 12/1896 | Boulanger | |
| 663,853 | A | 12/1900 | Boulanger | |
| 2,495,451 | A | 1/1950 | Gladstone | |
| 2,499,616 | A | 3/1950 | Walberg | |
| 2,572,504 | A | 10/1951 | Meriwether | |
| 4,154,137 | A | 5/1979 | Kobayashi | |
| 4,338,850 | A | 7/1982 | Payson | |
| 4,745,839 | A * | 5/1988 | Peraino | 84/411 M |
| 5,088,376 | A | 2/1992 | Crago et al. | |
| 5,107,741 | A | 4/1992 | Beals et al. | |
| 5,233,898 | A | 8/1993 | Montano | |
| 5,587,543 | A | 12/1996 | Da Silva Marques | |
| 6,586,664 | B1 | 7/2003 | Hubbell | |
| 2002/0069731 | A1 * | 6/2002 | Soucy | 82/163 |
| 2003/0037660 | A1 * | 2/2003 | Suenaga | 84/411 R |

* cited by examiner

*Primary Examiner*—Kimberly R Lockett
(74) *Attorney, Agent, or Firm*—Kirk A. Buhler; Buhler & Associates

(57) ABSTRACT

A percussion instrument muting apparatus that dampens the volume or tone from a drum. The apparatus is mounted within a drum, and the muting level can be adjusted with a tube that extends from the muting assembly out an existing breather hole, and to an adjustment bulb. The muting assembly is an expandable or inflatable bladder that makes contact with a portion of the drumhead or drum skin when the drum is played.

37 Claims, 3 Drawing Sheets

PERCUSSION INSTRUMENT REMOTE AIR MUTE

FIELD OF THE INVENTION

This invention relates to new and useful improvements in percussion muting apparatus for drums of various kinds. More particularly, the present invention relates to an air bladder that can be remotely filled and emptied from the exterior of the percussion instrument without requiring the instrument to be opened.

BACKGROUND OF THE INVENTION

The prior art discloses examples of drum muting apparatus for attenuating the volume or tone of percussion instruments, but none provide the combination of features disclosed and claimed herein.

Da Silva Marques U.S. Pat. No. 5,587,543 issued Dec. 24, 1996 discloses a musical instrument with a semi-circular or toroidal bladder disposed inside a drum. At least one of the outer skins are removed from the drum, a bladder is filled with air and placed inside the drum. The outer skin is then re-installed onto the drum. This invention serves the purpose of dampening the volume from the drum, but if the volume is too loud or too soft, the skin from the drum must be removed, and the amount of air in the bladder adjusted. The skin must then be re-installed and checked to determine if the volume is acceptable. In addition to the problems with adjusting the air with the bladder, if the user wants to play the drum without the dampening, the skin must be removed to remove or adjust the bladder.

Crago et al U.S. Pat. No. 5,088,376 issued Feb. 18, 1992 discloses a bass drum acoustic muffling apparatus that comprises a pillow or bladder installed inside a drum. The volume of the drum is adjusted by tightening or loosening a band connected to the pillow. When the band is pulled, the pillow is pulled away from one of the skins of the drum. When the tension on the band is released, the pillow is brought against the skin of the drum and the volume from the drum is reduced. This invention provided dampening of the volume from the drum, but the dampening effects only one of the skins, and the pillow may change the tone from the drum in addition to the volume from the drum.

Peraino U.S. Pat. No. 4,745,839 issued May 24, 1988 discloses a drum mute that is an air or foam filled pillow held within the drum with a rod that spans the sides of the drum. The position of the supporting rod and the amount of air pressure in the pillow determine the amount of attenuation to the volume from the drum. This invention serves the purpose of dampening the volume from the drum but the adjustment method is difficult, if the user wants to play the drum without the dampening, the skin must be removed to remove or adjust the air within the bladder.

Various prior inventions have been disclosed that attempt to provide percussion muting apparatus, but none of the listed inventions provide a pneumatic drum muting system that can be adjusted without removal of one or more skins from a drum. The ideal invention would provide muting from none to the maximum using only the existing holes fabricated with the drum. The proposed invention provides these features.

BRIEF SUMMARY OF THE INVENTION

One of the objects of this invention is to provide a drum muting system that can be adjusted remotely from the exterior of the drum.

Another object of the invention is to provide the drum muting system that can provide equal muting both skins of a drum.

Another object of the invention is to provide a drum muting system that can provide muting to only one skin of a drum.

Another object of the invention is to provide a drum muting system that can provide different levels of muting to each skin of a drum.

Another object of the invention is to provide a drum muting system that can be positioned in a variety of locations within a drum.

Another object of the invention is to provide a drum muting system that does not require modification to the shell of a drum.

Another object of the invention is to provide a drum muting system that uses the existing holes in the drum shell to adjust the amount of muting of the drum.

Another is to provide a drum muting system that does not affect the tone of a drum.

Another object of the invention is to provide a drum muting system that provide minimal drum head deformation to provide the muting.

Various objects, features, aspects, and advantages of the present invention will become more apparent from the following detailed description of preferred embodiments of the invention, along with the accompanying drawings in which like numerals represent like components.

DETAILED DESCRIPTION OF THE INVENTION

Figure 1:
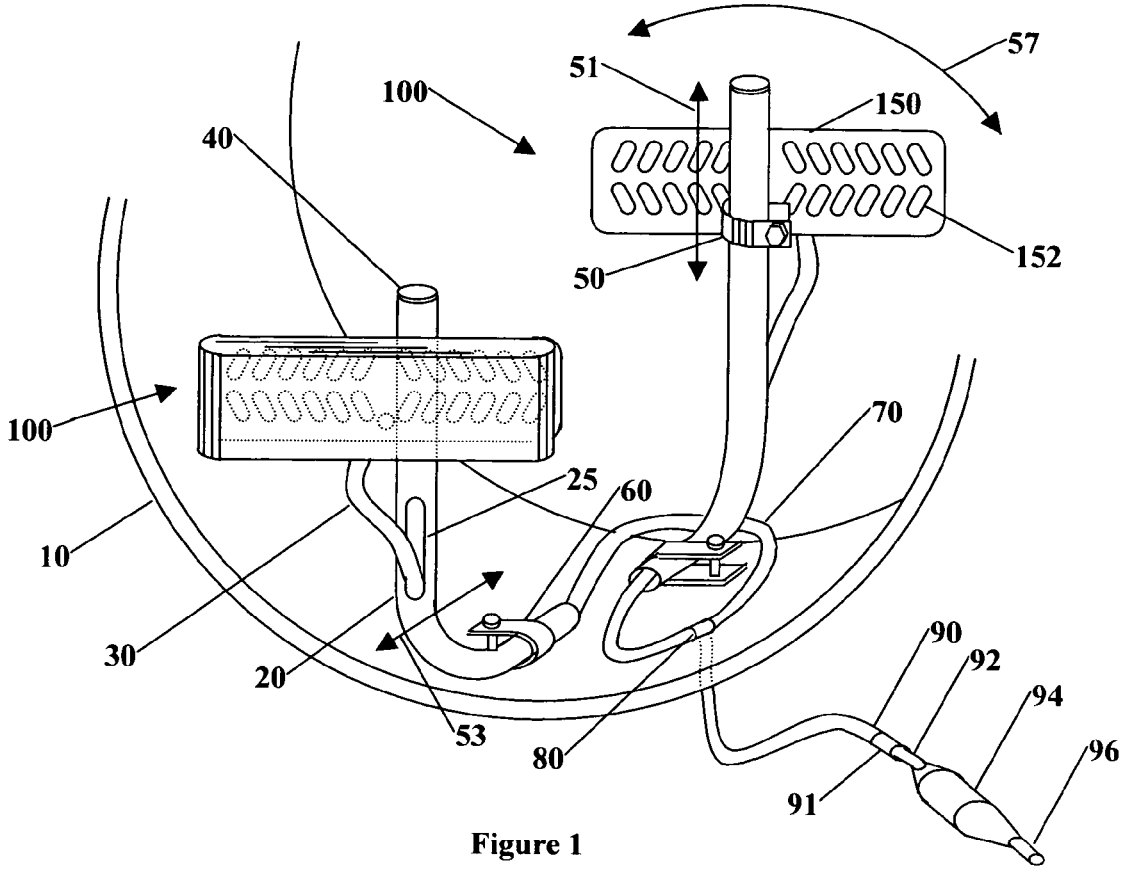
FIG. 1 is an isometric view of the remote air mute installed inside a drum.

Referring to FIG. 1, there is shown an isometric view of the remote air mute 100 installed inside a drum 10. In this figure, two separate air mute assemblies are shown. If the drum has only one skin or head surface, the remote air mute will only be attached to the side where the skin or drumhead is located. In this figure, the skin or drumhead is not shown, but will be described as item 15 in other figures. The drum 10 consists of a circular cylinder, but the shape of the drum may be any configuration where a skin or drum head can be stretched over the cylinder or the drum shell such that when the skin or drum head is struck with a stick, hand or other object, the instrument makes a sound. It is also possible to fabricate the shell and drum heads from a single molding operation where the shell of the drum is thicker than the head of the drum. The shell and skin or head are important items in the description of the usage of the invention, but the design, fabrication and use of these items are well known in the musical instrument industry. The remote air mute is intended for use inside the drum. In the preferred embodiment the remote air mute is installed inside a drum, and the installation does not require modification to the drum shell, or surfaces that a struck by the user.

Figure 2:
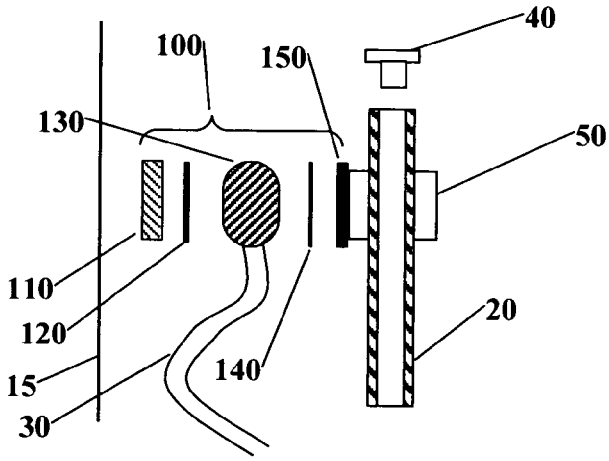
FIG. 2 is a detailed view of the remote air mute showing the components of the invention.

Refer to FIG. 2 that show a side view of the pad and expandable bladder portion of the remote air mute 100. The expandable bladder is made from a flexible minimally stretching material such as Mylar, vinyl, PVC, Polyester, polycarbonate, polyurethane, but the bladder may be made from an expanding material such as rubber or latex. The drumhead or skin 15 is shown in this figure. The front pad 110 is a semi-firm pad made of felt, rubber, Latex, Neoprene or other similar material that when brought in close proximity or makes contact with the skin or head of the drum while the instrument is being played, the pad attenuates the volume, overtones and or resonance of the sound from the drum. The pad does not have to be in constant contact with the head of the drum for the remote air mute to modify the sonic properties from the drum. A thick Mylar sheet 120 or similar material is located between the pad 110 and an expandable bladder 130. The Mylar sheet provides a rigid surface for the bladder to push against. This rigid surface helps to keep the bladder flatter as the bladder is filled with air. The muting pad 110 is attached to an expandable bladder 130 that can be filled or emptied of air. Varying amounts of air can be placed into or removed from the remote air mute to provide varying amounts of muting when the instrument is played. The bladder is attached to a rear support member 150 that supplies support to the bladder backer. The attachment of the pad to the Mylar and the Mylar to the bladder can be made using a variety of methods including, adhesive, ultrasonic, two part, or thermal bonding. It may also be possible to sew these components onto together.

The expandable bladder is connected to a hose 30 that is used to fill and empty the expandable bladder. The hose allows for a flexible connection from the bladder(s) to the filling location. The opposite side of the bladder is attached to a backing pad 140 that is then attached to a rear support 150. The backing pad can be fabricated from a variety of materials or adhesives that connect the bladder to the rear support. In the preferred embodiment, the rear support is an aluminum plate that has vent holes that allow the bladder to be supported without creating an air pocket between the bladder and the supporting plate. The supporting plate is secured to clamp 50 that allow the assembly to attach to tube 20. A plug 40 can optionally be placed on the end of the tube to reduce the possibility of damaging the drum when the remote air mute is being installed. The cap is also placed on the end of the tube to prevent or reduce resonance from the tube.

Referring back to FIG. 1 the remote air mute is shown attached to the vertical portion of tube 20 where clamp 50 is shown holding the remote air mute to the vertical portion of tube 20. An elongated slot 25 in the tube is also shown and the flexible tube 30 is shown entering the elongated slot. Tube 20 has a right angle bend and has a horizontal section that is secured to the drum shell with attachment clamp 60. The flexible tube 30 exits the horizontal portion of tube 20 and becomes tube 70. The tubes from two remote air mutes connect with a "T" tube connector 80 where the connector exits the drum shell.

Figure 3:
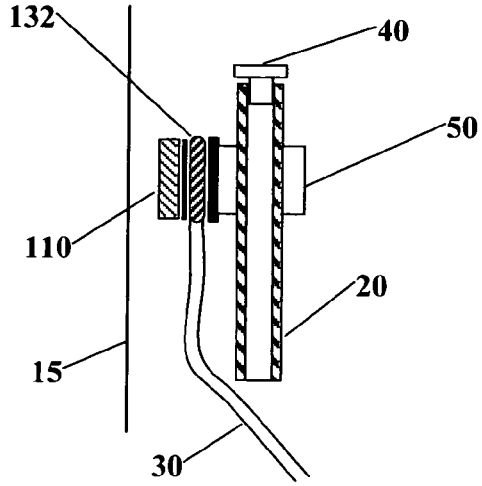
FIG. 3 is a view of the pad from the remote air mute in a retracted position.
Figure 4:
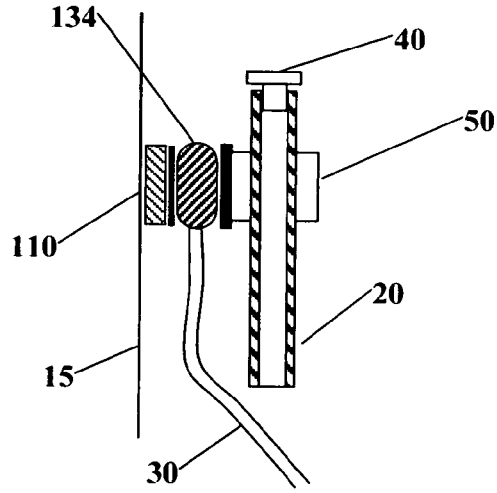
FIG. 4 is a view of the pad from the remote air mute in an extended position.

Clamp 60 and the tube "T" connector 80 utilize existing breather holes and or existing drum hardware in the drum. The hose 90 then extends out of the drum shell and terminates at a spring-loaded valve 91. A manual bulb pump 94 is inserted into the spring-loaded valve 91 to open the valve. When one side 92 of the manual pump 94 is inserted into the spring-valve and squeezed, air is pushed into the hose assembly and then fills the air bladder, making the bladder expand, and push against the side of the drumhead. This is shown in FIG. 4 where the expandable bladder 134 is shown expanded, and the pad 110 is shown near the drumhead 15. In the preferred embodiment, the bladder is expanded with air, but the bladder can be filled or expanded with any gas or medium that can expand the bladder such as $CO_2$, Argon, Helium, water, or even a powder. The vertical tube 20 is shown in this figure with the clamp 50, flexible hose 30 and the tube cap 40. The cap is also placed on the end of the tube to prevent or reduce resonance from the tube. Referring back to FIG. 1, when the opposite side 96 of the manual pump 94 is inserted into the spring-valve and squeezed, air is removed or vacuumed from the hose assembly, making the bladder collapse, and pulls the remote air mute away from the drum head. This is shown in FIG. 3 where the expandable bladder 132 is shown collapsed, and the pad 110 is shown moved away from the drumhead 15. The vertical tube 20 is shown in this figure with the clamp 50, flexible hose 30 and the tube cap 40.

Looking back at FIG. 1, the vent holes 152 in the back of plate 150 can be seen. This figure also shows the position adjustments that can be made to the remote air mute. The adjustments include positioning the height 51 of the remote air mute. The height adjustment is accomplished by loosening clamp 50, and sliding the remote air mute up and down the vertical portion of tube 20. The tube can be drawn or inserted from or into slot 25 to allow the tube to not make contact with the drumhead. The proximity of the remote air mute to the drumheads 53 can be adjusted by loosening clamp 60, and locating the remote air mute. The angle 57 of the remote air mute to with the drum head can also be adjusted by loosening clamp 60, and rotating the remote air mute until the remote air mute is in the desired position and clamping down the horizontal portion of tube 20. A number of different possible locations for the positioning the remote air mute to within the drum are shown in FIGS. 6, 7 and 8.

Figure 6:
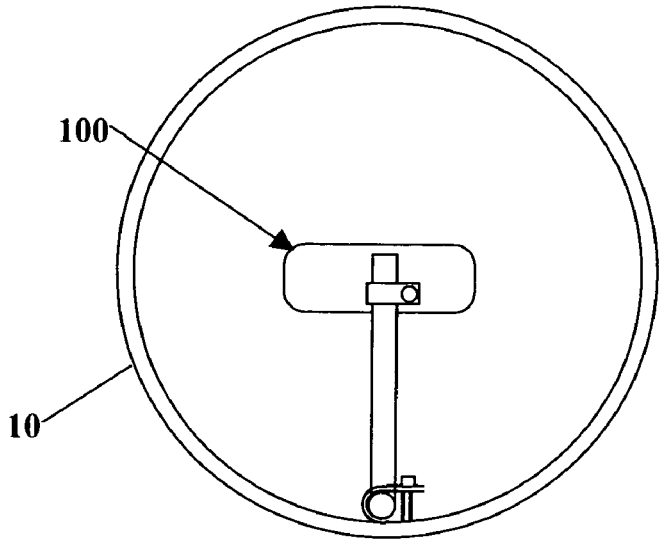
FIG. 6 is a view of the remote air mute in a drum making contact with the center of the drum
Figure 7:
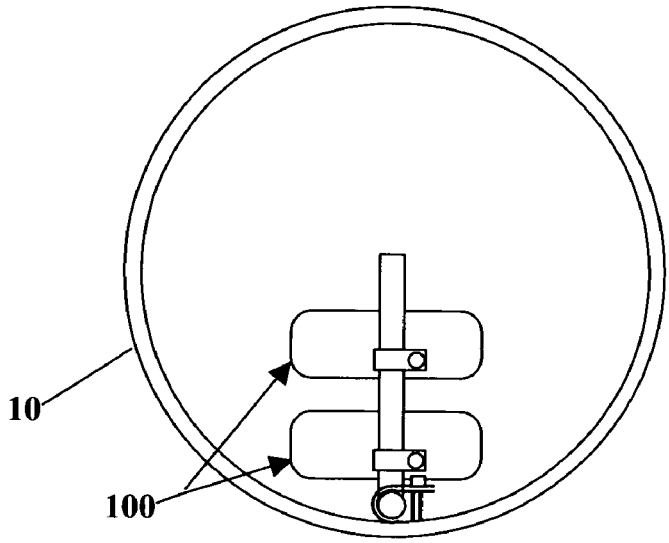
FIG. 7 is a view of two remote air mutes in a drum making contact to the lower portion of the drum skin.
Figure 8:
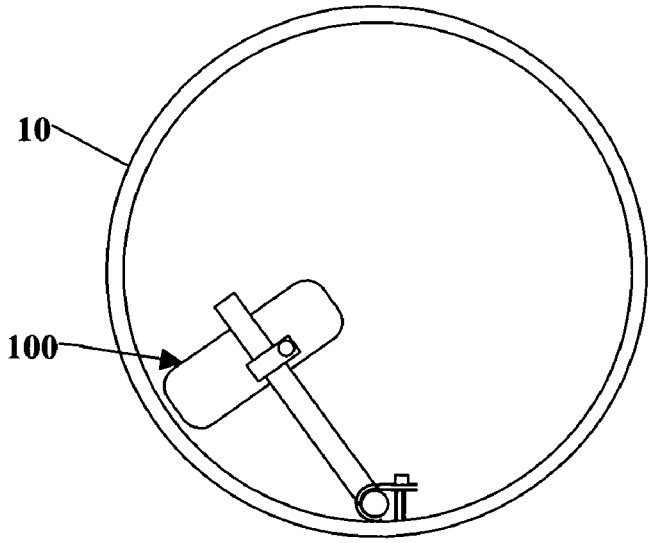
FIG. 8 is a view of the remote air mute spanning the skin of the drum from the side to the center of the drum.

FIGS. 6 to 8 show various locating where the remote air mute can be located and locked into position. FIG. 6 is a view of the remote air mute in a drum making contact with the center of the drum. The shell of the drum 10 is shown in this figure and the remote air mute 100 is shown where the remote air mute is placed at or near the center of the drum, and the pad spreads horizontally across the drumhead or skin. This positioning of the remote air mute reduces the greatest amount of travel of the drumhead. This position may also provide the greatest absorption of impact when the drum is struck, especially when the drum is struck in the center or on the remote air mute.

FIG. 7 is a view of two remote air mutes in a drum, making contact to the lower portion of one drum skin. The shell of the drum 10 is shown in this figure and the remote air mutes 100 are shown where the remote air mute is placed at or near an edge of the drum, near the shell of the drum. A number of location positions exist for the remote air mute between the position shown in FIG. 6 and FIG. 7. This positioning of the remote air mute in FIG. 6 reduces the greatest extreme drumhead movement. If the drumhead is struck with a light blow the remote air mute in FIG. 7 may have minimal attenuation of the sound if the upper pad 100 is removed.

FIG. 8 is a view of the remote air mute spanning the skin of the drum from the side to the center of the drum. The shell of the drum 10 is shown in this figure and the remote air mute 100 is shown where the remote air mute is placed radically from the edge of the shell of the drum and into towards the center of the drum. A number of location positions exist for the remote air mute between the position shown in FIG. 6, FIG. 7 and FIG. 8. This positioning of the remote air mute provides muting of both large drumhead movements and muting of small drumhead movement. It is also possible to rotate the remote air mute so the muting pad is closest to the drum shell, or further away from the drum shell near the center of the drum.

Figure 5:
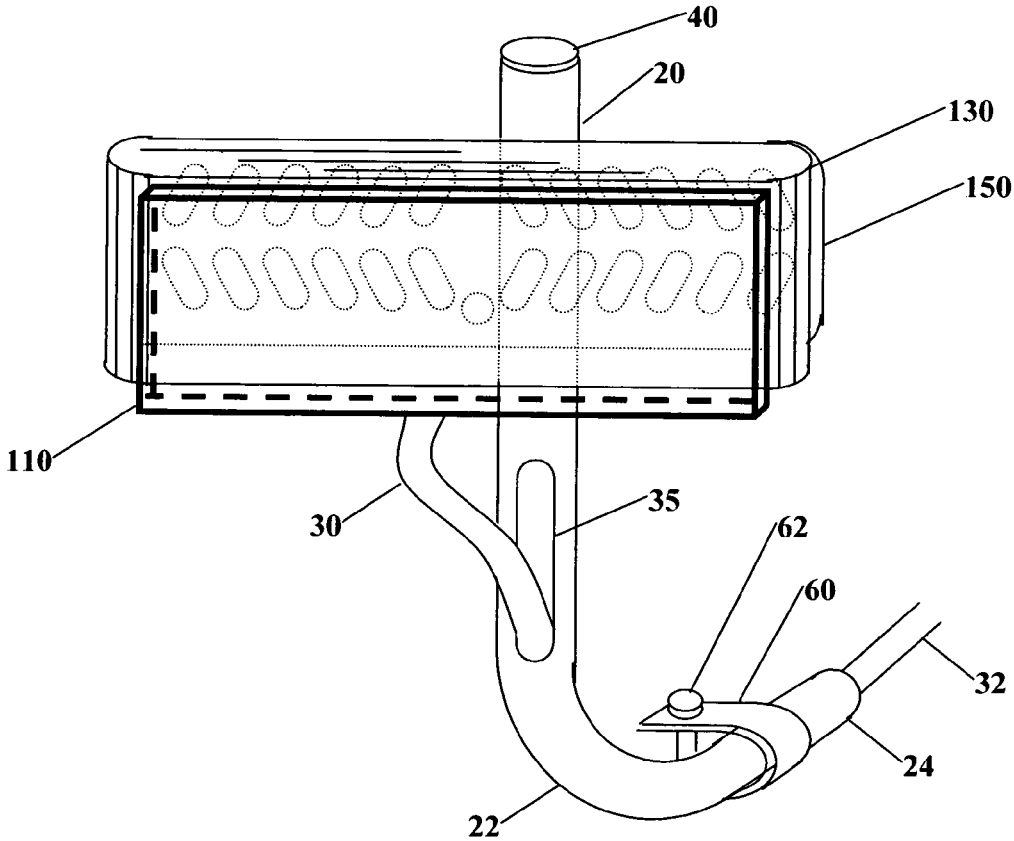
FIG. 5 is an isometric view of the remote air mute showing the front of the pad.

Refer now to FIG. 5 where a detailed isometric view of the remote air mute is shown with the front of the pad 110. The front pad is a semi-firm pad what makes contact with the skin or head of the drum while the instrument is being played. The pad does not have to be in constant contact with the head of the drum for the remote air mute to alter the sound from the drum. The pad is attached to an expandable bladder 130 that can be filled or emptied of air or other gas or media that can expand the bladder. Varying amounts of air can be placed into or removed from the remote air mute to provide varying amounts of muting when the instrument is played. The bladder is attached to a rear support member 150 that supplies rigid support to the air bladder. Vent holes 152 are shown in this view with dotted lines. A clamp holds the remote air mute assembly to the vertical section of the attachment tube 20. The top of tube 20 has a plug or cap 40 that protects the end of the tube from damaging the drumhead or the inside of the drum shell. The cap is also placed on the end of the tube to prevent or reduce resonance from the tube. The flexible air hose 30 extends from the air bladder into an elongated slot 35. The elongated slot adds protection to the flexible tube, keeps the tube from making contact with the drumhead, and provides a path for the hose to route back to the center of the drum. The flexible hose 30 bends around the bend in the tube 22 and exits the tube on the horizontal section 24 as item 32. The end of the horizontal rigid tube 24 is clamped with clamp 60 that is secured to the shell of the drum using existing drum hardware not shown. The hardware and clamp use existing holes in the shell of the drum. The hardware and clamp uses existing drum hardware.

In the embodiment shown, the remote air mute is used on the drumheads, and in most cases, and in some cases the drumheads are tuned to the same pitch. One of the major benefits of this invention is to allow the user the option to very the proximity of the muting pad(s) to the drumhead(s). Because the bladders in the invention are expandable, the amount of expansion can be adjusted without the removal of the drumheads. When the remote air mute is installed inside of the drum, spacers may be used to ensure placement of the muting pads are located the same distance from the from the drumheads. Because the air bladders are filled with air, both of the two bladders will fill with the same amount of air pressure. If upon installation the two air filled bladders are placed at slightly different distances from the drum heads, as the bladders are filled with air they will each exert the same pressure against each drum head because the pressure in each bladder will be the same due to pressure equalization in the filling line. It is also possible to have two separate air filling systems that allow different air pressure and bladder expansions to exist with each air bladder.

In another embodiment, the manual pump may be provided by an electric pump or a pressurized gas such as $CO_2$. In still another embodiment, the device can operate from a wired or wireless remote control to a mechanism mounted entirely within the drum. In still another embodiment, the invention may include a pressure gauge that shows the pressure within the air bladders, and may provide recommended pressures for different playing venues. In still another embodiment, the invention may not use air to fill the bladders, and they may be filled with fluid, or a foam and air combination.

In another contemplated embodiment, the mounting hardware may comprise a hollow threaded fastener where the filling tube can be connected to or passed through. In this embodiment the mounting a filling of the remote air mute can be attached and filled from a single location. The attachment of one two or more the muting pads can be made from the same mounting point.

In another embodiment, the expandable bladder is eliminated. When the expandable bladder is eliminated, the location of the muting pad is fixed within the shell of the drum, and then the drumhead(s) are mounted on the drum. This configuration does not allow remote adjustment of the muting system, but does provide muting of the sound from the drum. With fixed muting pads, gauges and guides can be provided to suggest location and distances of the pad to the drum head(s) when the drum is played at different venues.

Thus, specific embodiments and applications for a remote air muting system and method for drums have been disclosed. It should be apparent, however, to those skilled in the art that many more modifications besides those described are possible without departing from the inventive concepts herein. The inventive subject matter, therefore, is not to be restricted except in the spirit of the appended claims.

What is claimed is:

1. A drum muting system comprising:

an expandable bladder, the expandable bladder connected to a rigid mounting system that can mount the air expandable bladder to a drum, a hose connected to the expandable bladder where the hose can extend outside the shell of a drum, and installation gauges to set the distance between unexpanded muting pad(s) to the drumhead(s) or skin(s).

2. The drum muting system from claim 1 wherein the expandable bladder is made from Mylar, vinyl, PVC, Polyester, polycarbonate, polyurethane, rubber or latex.

3. The drum muting system from claim 1 wherein the muting pad is made from felt, foam rubber, rubber, Latex, Neoprene or a combination thereof.

4. The drum rigid mounting system from claim 1 wherein the mounting system is constructed from a material from a group consisting of aluminum, steel, plastic, composites, and wood.

5. The drum muting system from claim 1 wherein the hose connects from the expandable bladder to exterior of the drum shell.

6. The drum muting system from claim 1 wherein the muting system uses existing holes and or hardware in the drum shell.

7. The drum muting system from claim 1 wherein the system also includes a pressure gauge.

8. The drum muting system from claim 1 comprises more than one muting pad.

9. The drum muting system from claim 1 further comprises a spring loaded check valve.

10. The drum muting system from claim 1 further comprises a filling and or evacuation device.

11. The drum muting system from claim 1 allows multiple muting pads to be expanded to different amounts.

12. The drum muting system from claim 1 where multiple muting pads can each be positioned for different location, orientations, and distances from the drumheads.

13. A drum muting system comprising:

a pad attached to a expandable bladder, and the expandable bladder is connected to the shell of a drum and said expandable bladder is connected to a removable spring loaded check valve for temporal connection of a pump to fill and evacuate air from within said expandable bladder.

14. The drum muting system from claim 13 wherein the expandable bladder is made from Mylar, vinyl, PVC, Polyester, polycarbonate, polyurethane, rubber or latex.

15. The drum muting system from claim 13 wherein the muting pad is made from felt, foam rubber, rubber, Latex, Neoprene or a combination thereof.

16. The drum rigid mounting system from claim 13 wherein the mounting system is constructed from a material from a group consisting of aluminum, steel, plastic, composites and wood.

17. The drum muting system from claim 13 wherein further includes a hose connecting from the expandable bladder to exterior of the drum shell.

18. The drum muting system from claim 13 wherein the muting system uses existing holes and or hardware in the drum shell.

19. The drum muting system from claim 13 wherein the system also includes a pressure gauge.

20. The drum muting system from claim 13 wherein the system also includes installation gauges to set the distance of the muting pad(s) to the drumhead(s) or skin(s).

21. The drum muting system from claim 13 further comprises a filling and or evacuation device.

22. The drum muting system from claim 13 allows multiple muting pads to be expanded to different amounts.

23. The drum muting system from claim 13 where multiple muting pads can each be positioned for different location, orientations, and distances from the drumheads.

24. A drum muting system comprising:

at least two muting pad attached to a rigid mounting system wherein the rigid mounting system is attached to the inside of the shell of a drum where multiple muting pads can each be positioned for different location, orientations, and distances from the drum heads.

25. The drum muting system from claim 24 wherein the muting pad is made from felt, foam rubber, rubber, Latex, Neoprene or a combination thereof.

26. The drum rigid mounting system from claim 24 wherein the mounting system is constructed from a material from a group consisting of aluminum, steel, plastic, composites and wood.

27. The drum muting system from claim 24 wherein the muting system uses existing holes and or hardware in the drum shell.

28. The drum muting system from claim 24 wherein the system also includes installation gauges to set the distance of the muting pad(s) to the drumhead(s) or skin(s).

29. A method of muting a drum comprising:

providing a drum with at least one drumhead or skin, providing at least one expandable bladder providing a semi-firm pad located between the drumhead or skin and the air expandable bladder, providing a mounting system to mount the expandable bladder within the drum, and expanding the bladder such that said semi-firm pad is brought into proximity to the drumhead such that when the drum is played the muting system attenuates the sound from the drum.

30. The method of muting a drum from claim 29 further includes providing a hose from the expandable bladder, and extending the hose to the exterior of the drum.

31. The method from claim 29 further includes providing a check valve to maintain pressure in the expandable bladder.

32. The method from claim 29 further includes adjusting the pressure, volume or amount of air in the expandable bladder.

33. The method from claim 29 further includes providing more than one expandable bladder for each drumhead or skin.

34. The method from claim 29 further includes mounting the muting system to a drum using the existing holes and or hardware in the shell of the drum.

35. The method from claim 29 further includes creating at least one hole in the shell of the drum.

36. The method from claim 29 further includes providing a gauge to position the muting system from the drumhead

37. The method from claim 29 wherein said semi-firm pad is made from felt, foam rubber, rubber, Latex, Neoprene or a combination thereof.

* * * * *